US006969982B1

(12) United States Patent
Caldwell

(10) Patent No.: US 6,969,982 B1
(45) Date of Patent: Nov. 29, 2005

(54) VOLTAGE REGULATION USING CURRENT FEEDBACK

(75) Inventor: Joshua William Caldwell, Tucson, AZ (US)

(73) Assignee: National Semiconductor Corporation, Santa Clara, CA (US)

( * ) Notice: Subject to any disclaimer, the term of this patent is extended or adjusted under 35 U.S.C. 154(b) by 146 days.

(21) Appl. No.: 10/678,534

(22) Filed: Oct. 3, 2003

(51) Int. Cl.[7] ..... G05F 3/16
(52) U.S. Cl. ..... 323/313; 323/273; 323/315
(58) Field of Search ..... 323/311–315, 273

(56) References Cited

U.S. PATENT DOCUMENTS 6,075,351 A * 6/2000 Benes ..... 323/280
6,501,254 B2 * 12/2002 Spalding, Jr. ..... 323/312

* cited by examiner

*Primary Examiner*—Gary L. Laxton

(57) ABSTRACT

A circuit having a voltage regulated by a reference current. The circuit includes a current feedback loop and a reference current source that is capable of producing a reference current. The current feedback loop includes an output device, a voltage to current converter, and a current feedback element. The voltage to current converter is coupled to the output device. A node of the voltage to current converter is the regulated voltage. The current feedback element is coupled to the voltage to current converter to provide a feedback current from the voltage to current converter to compare with the reference current to produce an error signal that is input to a control terminal of the output device. Thus, the current feedback loop regulates the voltage at the node of the voltage to current converter.

18 Claims, 4 Drawing Sheets

VOLTAGE REGULATION USING CURRENT FEEDBACK

TECHNICAL FIELD

The present invention generally pertains to the field of electronic circuits. More particularly, embodiments of the present invention are related to a circuit for regulating a voltage by using current feedback.

BACKGROUND ART

Many electronic circuits have a need for a regulated voltage. Conventionally, a regulated voltage is provided as illustrated in FIG. 1. FIG. 1 shows a simple circuit 100 for regulating a voltage ($V_{out}$) by using voltage feedback in a loop having a differential amplifier 110. The output of the differential amplifier 110 is coupled to the gate of an output transistor 120. The voltage $V_{out}$ is taken from the drain of the output transistor 120. A reference voltage ($V_{ref}$) is input to the negative input of the differential amplifier 110. The voltage at node A is fed into the positive input of the differential amplifier 110. The voltage at node A is some fraction of the voltage $V_{out}$, based on the relative sizes of the voltage divider resistors 125 and 130. The circuit 100 keeps the voltage $V_{out}$ regulated by forcing the voltage at node A to be equal to the reference voltage $V_{ref}$. By appropriate sizing of voltage divider resistors 125 and 130, a suitable voltage $V_{out}$ may be maintained.

However, if the voltage reference $V_{ref}$ has a non-zero temperature coefficient, then the voltage $V_{out}$ will be temperature dependent. Thus, a zero temperature coefficient reference voltage $V_{ref}$ must be supplied to the negative input of the differential amplifier 110. As the circuit 100 regulates the voltage at node A to be equal to the reference voltage $V_{ref}$, and as the voltage $V_{out}$ is somewhat larger than this because of the voltage divider resistors 125 and 130, the voltage $V_{out}$ will exhibit an even larger voltage swing than $V_{ref}$ exhibits as temperature changes.

A second drawback with the conventional circuit 100 of FIG. 1 is the requirement of a differential amplifier 110 and the associated large device count needed to implement the differential amplifier. As chip real estate is a precious commodity, the large device count is undesirable.

Thus, a need exists for a voltage regulation circuit. A further need exists for a voltage regulation circuit that does not require a zero temperature coefficient reference voltage. A still further need exists for a voltage regulation circuit that does not require a differential amplifier to regulate the voltage. A still further need exists for a voltage regulation circuit that is compatible with and can be fabricated economically with existing semiconductor fabrication techniques.

SUMMARY

The present invention provides a voltage regulation circuit using current feedback. Embodiments of the present invention provide a voltage regulation circuit that does not require a zero temperature coefficient reference voltage. Embodiments of the present invention provide a voltage regulation circuit that does not require a differential amplifier to regulate the voltage. Embodiments of the present invention provide a voltage regulation circuit that is compatible with and can be fabricated economically with existing semiconductor fabrication techniques.

A circuit having a voltage regulated by a reference current is disclosed. In one embodiment in accordance with the present invention, the circuit comprises a current feedback lop and a reference current source that is capable of producing a reference current. The current feedback loop includes an output device, a voltage to current converter, and a current feedback element. The voltage to current converter is coupled to the output device. The voltage to be regulated is at a node of the voltage to current converter. The current feedback element is coupled to the voltage to current converter to provide a feedback current from the voltage to current converter to compare with the reference current. The comparison produces an error signal that is input to a control terminal of the output device. Thus, the current feedback loop regulates the voltage at the node of the voltage to current converter.

Another embodiment in accordance with the invention is a method of regulating a voltage with current feedback. The method comprises producing a reference current, producing a feedback current based on a voltage, comparing the reference current with the feedback current to produce an error signal, and regulating the voltage by using the error signal to control an output device.

These and other advantages of the present invention will no doubt become obvious to those of ordinary skill in the art after having read the following detailed description of the preferred embodiments which are illustrated in the various drawing figures.

BRIEF DESCRIPTION OF THE DRAWINGS

The accompanying drawings, which are incorporated in and form a part of this specification, illustrate embodiments of the invention and, together with the description, serve to explain the principles of the invention.

BEST MODE FOR CARRYING OUT THE INVENTION

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well-known methods, procedures, components, and circuits have not been described in detail as not to unnecessarily obscure aspects of the present invention.

Figure 1:
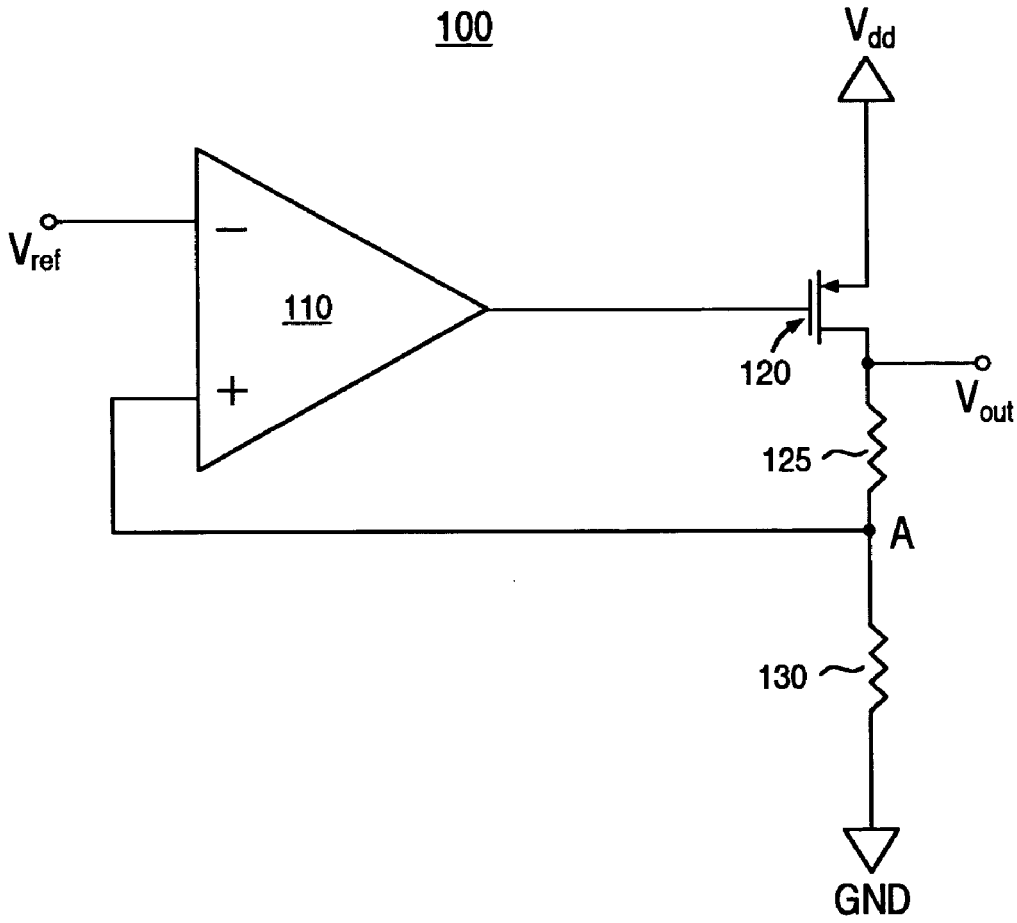
Fig. 1 (Prior Art)
FIG. 1 is a schematic of a conventional circuit for regulating voltage.
Figure 2:
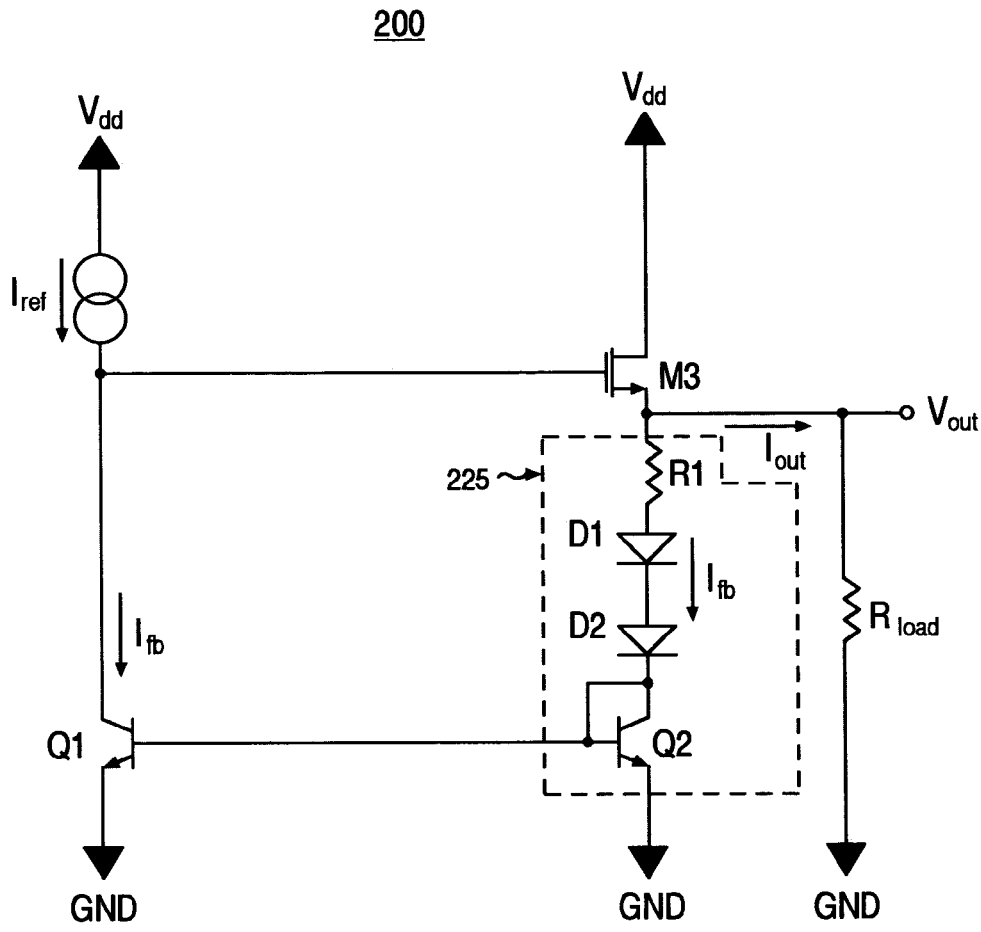
FIG. 2 is a schematic of a circuit that regulates voltage using current feedback, according to an embodiment of the present invention.

FIG. 2 is a schematic of a circuit 200 for regulating voltage using current feedback, according to an embodiment of the present invention. The circuit 200 uses a current feedback loop and a reference current to regulate 20 a voltage. By using a current feedback loop, the circuit 200 does not require a differential amplifier to regulate the voltage. Moreover, the circuit 200 does not require a reference voltage as an input to a differential amplifier.

Moreover, the circuit 200 does not require a non-zero temperature coefficient reference voltage.

The circuit 200 of FIG. 2 has an output transistor M3, which supplies an output current $I_{out}$ for a load impedance ($R_{load}$) and a current through the voltage to current converter 225. The current through the voltage to current converter 225 will be referred herein to as a feedback current $I_{FB}$. The voltage to current converter 225 include a temperature compensation resistor R1, diodes D1 and D2, and transistor Q2, in this embodiment. The circuit 200 has a current feedback loop, which comprises the output transistor M3, the voltage to current converter 225, and the mirror transistor Q1. A node of the voltage to current converter 225 is the regulated voltage. For example, $V_{out}$ is the regulated voltage in this embodiment. Those of ordinary skill in the art will appreciate that variations exist for the configuration of the voltage to current converter 225 and what node of the voltage to current converter 225 is selected for the regulated voltage.

A basic description of operation of the circuit 200 is that the feedback 20 current $I_{FB}$ will be forced to be substantially equal to the reference current $I_{REF}$ because of the feedback loop. The difference between the two currents, $I_{FB}$ and $I_{REF}$, will be referred to as the error current $I_{error}$ (not depicted in Figures). The error current produces a control voltage due to the output impedance of Q1, which affects a control terminal (e.g., gate) of the output transistor M3. The control voltage controls the current supplied by the output transistor M3 to the load impedance $R_{load}$ and to the voltage to current converter 225. The magnitude of the feedback current $I_{FB}$ through the voltage to current converter 225 determines the magnitude of the voltage $V_{out}$. By appropriate selection of a reference current $I_{REF}$ and voltage to current converter 225, a suitable voltage $V_{out}$ is produced and regulated. Moreover, the voltage $V_{out}$ is not dependent upon temperature to a significant degree provided the reference current is PTAT (Proportional to Absolute Temperature). Further, if the magnitude of the load impedance $R_{load}$ changes, the feedback loop causes the output transistor M3 to output a current to provide a suitable output current $I_{out}$ for the load impedance $R_{load}$ given the magnitude of the voltage $V_{out}$, while still supplying the feedback current $I_{FB}$ to the voltage to current converter 225.

The operation of circuit 200 will now be examined in more detail. The relationship between the voltage $V_{out}$ and the feedback current $I_{FB}$ is given by Equation 1, where R1 is the output resistor R1.

Equation 1:

$$I_{FB} = \frac{(V_{OUT} - 3V_{BE})}{R_1}$$

In Equation 1, the voltage $V_{BE}$ is the base to emitter voltage across the transistor Q2 or the forward bias voltage drop across one of the diodes D1 or D2. Those of ordinary skill in the art will appreciate that the diodes D1 and D2 may be fabricated as a transistor with its collector electrically coupled to its base. Thus, the term $V_{BE}$ is used to refer to the forward bias voltage drop across the diodes D1 and D2. Essentially any number of components (diodes or transistors) may be used to create a suitable voltage $V_{out}$, so long as there is at least one such component.

The feedback current $I_{FB}$ is mirrored from transistor Q2 to mirror transistor Q1 and subtracted from the reference current $I_{REF}$. The two competing currents on gate of output transistor M3 forms an amplifier and regulates the feedback current $I_{FB}$ to be substantially the same as the reference current $I_{REF}$, depending on the output impedance of mirror transistor Q1. The error current $I_{error}$ adjusts the gate voltage of output transistor M3 through the output impedance of Q1 so that the feedback current $I_{FB}$ is provided according to Equation 2.

Equation 2:

$$I_{FB} = I_{REF}\left(\frac{A_S}{1 + A_S}\right)$$

In Equation 2, $A_S$ is the current loop gain from $I_{REF}$ to $I_{FB}$. If $A_S$ is sufficiently large, $I_{REF}$ to $I_{FB}$ are substantially equal. In this embodiment, the reference current $I_{REF}$ is Proportional to Absolute Temperature (PTAT). Thus, the reference current $I_{REF}$ behaves in accordance to Equation 3, wherein $V_t$ is the thermal voltage, N is the transistor size ratio of a transistor used in the PTAT current generator, and R2 is the resistor used in the PTAT current generator.

Equation 3:

$$I_{REF} = \frac{V_T Ln(N)}{R_2}$$

The ability of the circuit 200 to produce a substantially zero temperature coefficient signal will now be discussed. First, it is noted that one or more of the components of the voltage to current converter 225 have a negative temperature coefficient. For example, the two diodes D1 and D2 and the transistor Q2 may exhibit a forward bias voltage drop of approximately 800 mV at a first temperature and a forward bias voltage drop of approximately 400 mV at a second temperature that is high relative to the first temperature. The result of this would be a drop in the voltage $V_{out}$, at the second, higher, temperature, relative to the voltage $V_{out}$ at the lower temperature were it not for the presence of the temperature compensation resistor R1. However, the voltage drop across temperature compensation resistor R1 is designed to compensate for the negative temperature coefficient of the diodes D1 and D2 and transistor Q2. For example, the feedback current $I_{FB}$ effectively causes the voltage across the temperature compensation resistor R2 to have a positive temperature coefficient. The feedback current $I_{FB}$ is PTAT because it is substantially equal to the PTAT reference current $I_{REF}$. The temperature compensation resistor R2 can be fabricated or trimmed such that the voltage to current converter 225 as a group have a temperature coefficient that is substantially zero.

Equations 4 and 5 describe the DC steady state voltage $V_{OUT}$, wherein the terms are previously defined herein.

Equation 4:

$$V_{OUT} = 3V_{BE} + R_1\left(\frac{V_T Ln(N)}{R_2}\right)$$

Equation 5:

$$V_{OUT} = 3\left(V_{BE} + R_1\left(\frac{V_T Ln(N)}{3R_2}\right)\right)$$

If the load impedance $R_{load}$ drops, then the voltage $V_{out}$ may be maintained by the current regulation loop as follows. A drop in load impedance $R_{load}$ pulls the voltage $V_{out}$ down, which also reduces the magnitude of the feedback current $I_{FB}$. However, if the feedback current $I_{FB}$ is pulled down, then the comparison of the feedback current $I_{FB}$ with the reference current $I_{REF}$ produces a greater error current $I_{error}$. A greater error current $I_{error}$ produces a larger voltage on the gate of the output transistor M3 to output a greater current, which forces up the voltage $V_{out}$, as well as forcing up the feedback current $I_{FB}$. The DC steady state is provided above in Equation 4. Thus, the circuit 200 causes the output transistor M3 to output a sufficient current to both produce an appropriate feedback current $I_{FB}$ to maintain the voltage $V_{out}$ and a suitable output current for the load impedance $R_{load}$ given the voltage $V_{out}$.

Figure 3:
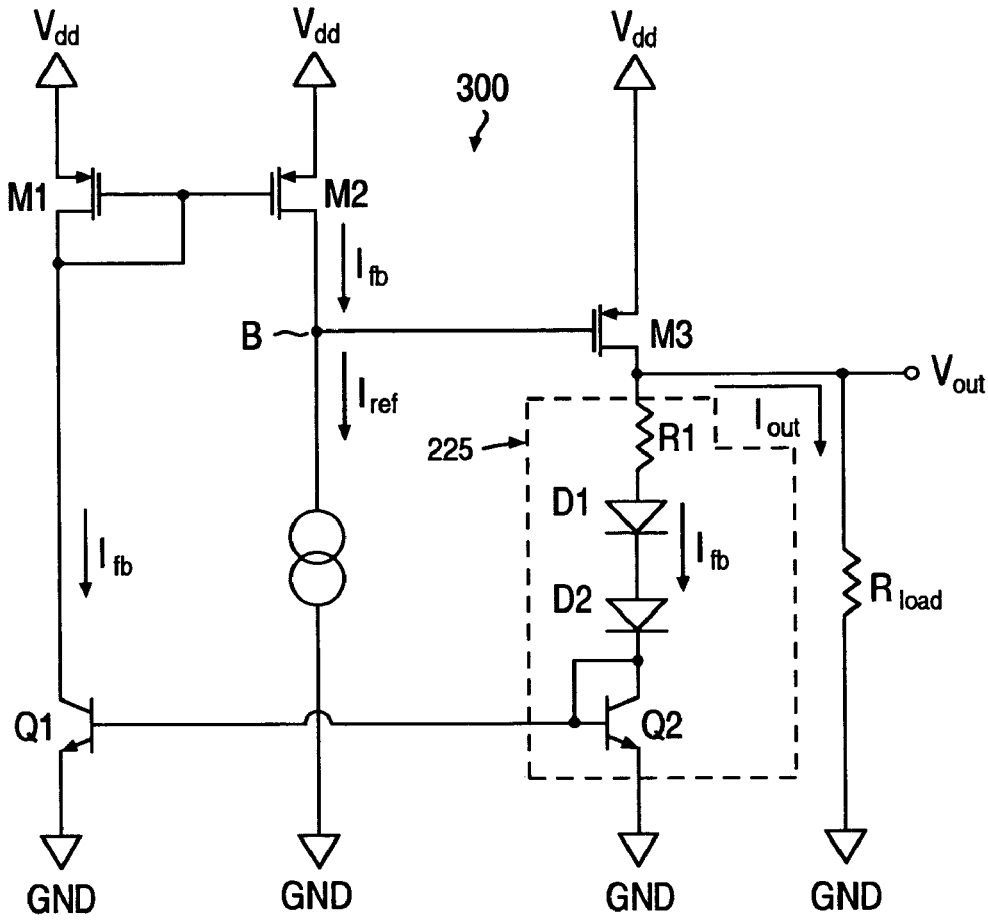
FIG. 3 is a schematic of a circuit, which has a p-channel output transistor, that regulates voltage using current feedback, according to a second embodiment of the present invention.

FIG. 3 illustrates a circuit 300 for regulating voltage using a feedback current and using a p-channel output transistor, in accordance with an embodiment of the present invention. In this embodiment, a current mirror formed by MOS transistors M1 and M2 is used to provide the feedback current $I_{FB}$ to node B, which is the input of the output transistor M3. The operation of circuit 300 is similar to circuit 200 and will not be discussed in detail. In this embodiment, the two competing currents $I_{REF}$ and $I_{FB}$ and the output impedance of transistor M2 on gate of output transistor M3 forms an amplifier and regulates the feedback current $I_{FB}$ to be substantially the same as the reference current $I_{REF}$, depending on the output impedance of transistor M2. Any number of components (e.g., diodes and transistors) may be used in the voltage to current converter 225, so long as there is at least one such component.

Those of ordinary skill in the art will recognize that other circuit components may be used within the scope and spirit of the present invention. For example, bipolar transistors may be used instead of any of the MOS transistors in circuit 200 or 300.

Figure 4:
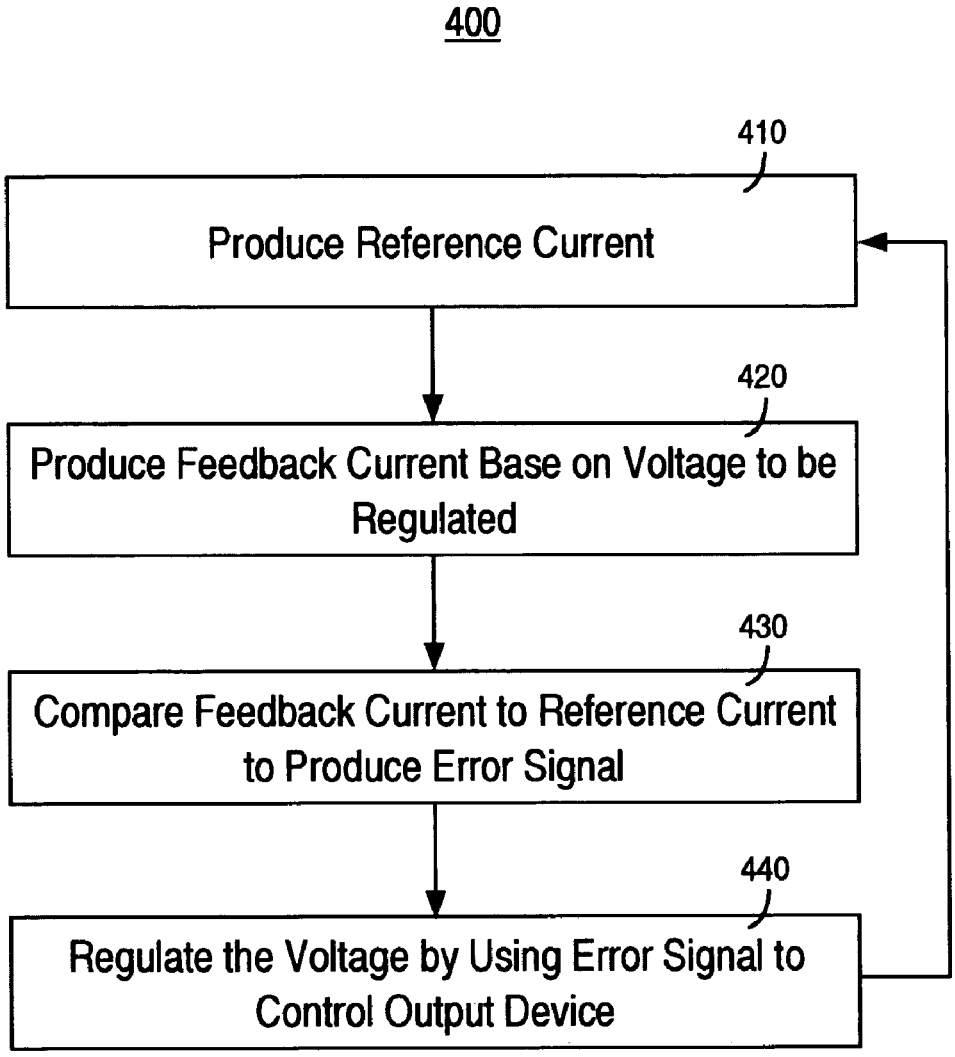
FIG. 4 is a flowchart illustrating steps of a process of regulating voltage using current feedback, according to embodiment of the present invention.

An embodiment of the present invention is a method of regulating voltage using current feedback. FIG. 4 illustrates steps of such a process.

It will be understood that process 400 of FIG. 4 may be implemented with a circuit such as circuits 200 and 300; however, the present embodiment is not limited to these circuits. It will also be understood that the steps of process 400 are described in a particular order as a matter of convenience and that various steps may occur essentially concurrently. For example, the process 400 involves a feedback loop, and as such, the various steps interact with one another. Process 400 of FIG. 4 includes, at step 410, producing a reference current. The reference current may be produced by a PTAT current source.

Step 420 comprises producing a feedback current based on a voltage to be regulated. This voltage may be referred to as an output voltage. As the magnitude of the feedback current is derived from the regulated voltage, its magnitude may conversely be used to control the magnitude of the regulated voltage. The generation of the feedback current may be accomplished by providing components such as the voltage to current converter 225 of FIGS. 2 and 3 such that a current is produced in them under normal operating conditions.

Step 430 comprises comparing the reference current with the feedback current to produce an error signal. This step may include running an error current, which is produced from the comparison of the reference current with the feedback current, through an impedance to create an error voltage. For example, the impedance may be a transistor's output impedance. The feedback current may be provided to a convenient node to compare with the reference current by the use of one or more current mirror devices. Moreover, a single electronic component may be used both in the providing the feedback current back to the reference current and for regulating the regulated voltage. For example, transistor Q2 in circuit 200 and 300 is used as part of a current mirror and as a part of the voltage to current converter.

Step 440 comprises regulating the regulated voltage by using the error signal to control an output device. The output device may be a transistor. The output device has a current that has one component that is the feedback current and another component that is an output current for a load impedance. The load impedance may be variable. As such, the output current will change for a given regulated voltage. Thus, the output device puts out a total current that varies and is appropriate to supply the feedback current and any output current, depending on the load impedance.

Embodiments of the present invention may use p-channel devices or n-channel devices. Moreover, the present invention is not limited to metal oxide field effect devices, for example, bipolar junction devices may also be used. Embodiments of the present invention are compatible with voltage regulators and battery charging systems; however, the present invention is not limited to use in voltage regulators and/or battery charging applications. Embodiments of the present invention are well suited for use as a low-dropout (LDO) voltage regulator.

Therefore, it will be seen that embodiments of the present invention provide voltage regulation by using current feedback. Embodiments of the present invention provide a voltage regulation circuit that does not require a zero temperature coefficient reference voltage. Embodiments of the present invention provide a voltage regulation circuit that does not require a differential amplifier to regulate the voltage. Embodiments of the present invention provide a voltage regulation circuit that is compatible with and can be fabricated economically with existing semiconductor fabrication techniques.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. A voltage regulation circuit using current feedback, comprising:

a reference current source capable of producing a reference current that is proportional to absolute temperature (PTAT);

a current feedback loop comprising:

an output device having a control terminal;

a voltage to current converter comprising a negative temperature coefficient element and an element that is configured to substantially cancel said negative temperature coefficient by passing said PTAT current and coupled to said output device, a regulated voltage at a node of said voltage to current converter; and a current feedback element coupled to the voltage to current converter to provide a feedback current from said voltage to current converter to compare with said reference current to produce an error signal that is coupled to said control terminal, wherein the current feedback loop regulates the voltage at the node of said voltage to current converter.

2. The circuit of claim 1, wherein said voltage to current converter is configured to regulate the voltage at the node by passing said feedback current.

3. The circuit of claim 1, wherein said voltage to current converter comprises a diode and an impedance device.

4. The circuit of claim 1, further comprising a device that produces said error signal by running through the device a current formed by the comparison of said reference current to said feedback current.

5. The circuit of claim 1, wherein said voltage to current converter comprises a transistor configured as part of a current mirror.

6. A circuit having a voltage regulated by a reference current, comprising:

an output transistor having a control terminal, said output transistor coupled to an output node;

a voltage to current converter coupled to said output transistor, wherein a regulated voltage is at a node of said voltage to current converter;

a reference current source coupled to said control terminal of said output transistor and producing said reference current; and an element coupled to the voltage to current converter to provide a feedback current from said voltage to current converter to compare with said reference current to produce a control voltage that is input to said control terminal, wherein said control voltage controls said output transistor to produce said feedback current to said voltage to current converter and an output current to said output node.

7. The circuit of claim 6, wherein the voltage to current converter is configured to regulate the voltage at the node by passing the feedback current through said voltage to current converter.

8. The circuit of claim 6, wherein the control voltage controls the output transistor to deliver an output current whose magnitude depends on load impedance.

9. The circuit of claim 6, wherein said voltage at the node is regulated without a reference voltage.

10. The circuit of claim 6, wherein said voltage at the node is regulated without a differential amplifier.

11. The circuit of claim 6, wherein the reference current is proportional to absolute temperature (PTAT).

12. The circuit of claim 11, wherein the voltage to current converter comprises a negative temperature coefficient element and an element that is configured to substantially cancel said negative temperature coefficient by passing said PTAT current.

13. A method of regulating a voltage with current feedback, comprising:

producing a reference current;

producing a feedback current based on said voltage;

comparing said reference current with said feedback current to produce an error signal, wherein said comparing comprises running an error current, which is produced by said comparing said reference current with said feedback current, through the impedance of a transistor to produce said error signal; and regulating said voltage by using said error signal to control an output device.

14. The method of claim 13, wherein said regulating comprises controlling the output device to output a suitable current for said feedback current and any output current provided to a load impedance coupled to the said voltage.

15. The method of claim 14, wherein impedance of said load impedance is variable.

16. The method of claim 13, wherein said producing the reference current comprises producing a proportional to absolute temperature (PTAT) current.

17. A method of regulating a voltage with current feedback, comprising:

producing a reference current;

producing a feedback current based on said voltage, comparing said reference current with said feedback current to produce an error signal; and regulating said voltage by using said error signal to control an output device, wherein said regulating comprises running said feedback current through a component having a negative temperature coefficient and a component to compensate for said component with a negative temperature coefficient.

18. The method of claim 17, wherein said producing the reference current comprises producing a proportional to absolute temperature (PTAT) current.

* * * * *